United States Patent [19]

Tuten

[11] 4,142,442

[45] Mar. 6, 1979

[54] DIGITAL FUZE

[75] Inventor: William J. Tuten, Richmond, Ind.

[73] Assignee: Avco Corporation, Wilmington, Mass.

[21] Appl. No.: 205,939

[22] Filed: Dec. 8, 1971

[51] Int. Cl.[2] ..... F42C 17/00

[52] U.S. Cl. ..... 89/6.5; 102/215; 102/276

[58] Field of Search ..... 89/6.5, 6, 1 R; 102/70.2 R; 340/168 R, 146.2; 343/6.5 SS

[56] References Cited

U.S. PATENT DOCUMENTS

| | | | |
|---|---|---|---|
| 3,169,242 | 2/1965 | Davis et al. | 343/6.5 SS |
| 3,209,350 | 9/1965 | Davis et al. | 343/6.5 SS |

*Primary Examiner*—Charles T. Jordan

*Attorney, Agent, or Firm*—Charles M. Hogan; Irwin P. Garfinkle

[57] ABSTRACT

The time-to-go of the fuze of an artillery shell is digitally set after the round has been fired but before it leaves the muzzle of the gun. The communications link for setting the fuze includes a transmitting coil mounted on the gun muzzle and a receiving coil mounted on each shell round. The transmitting coil is energized with a plurality of signals on discrete frequencies. The output from the receiving coil is detected to derive one binary digit representing each discrete frequency. All the binary digits, "0" or "1", are simultaneously set into a binary counter in the fuze, so that the binary number represents the time-to-go.

13 Claims, 6 Drawing Figures

INVENTOR.
WILLIAM J. TUTEN
BY Charles M. Hogan
Irwin P. Garfinkle
ATTORNEYS.

Fig 4
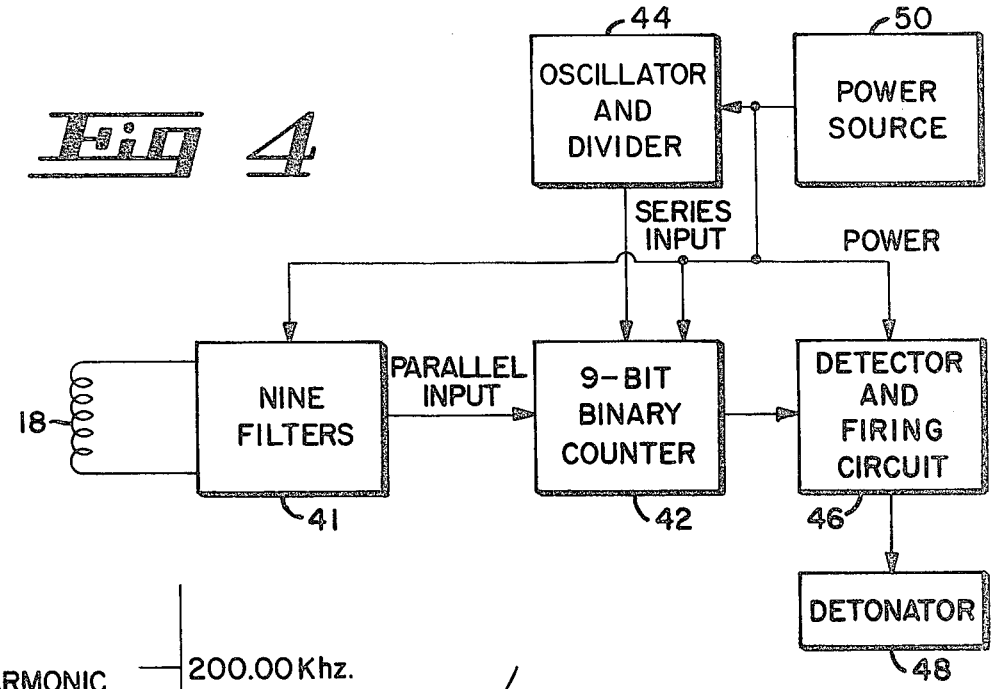
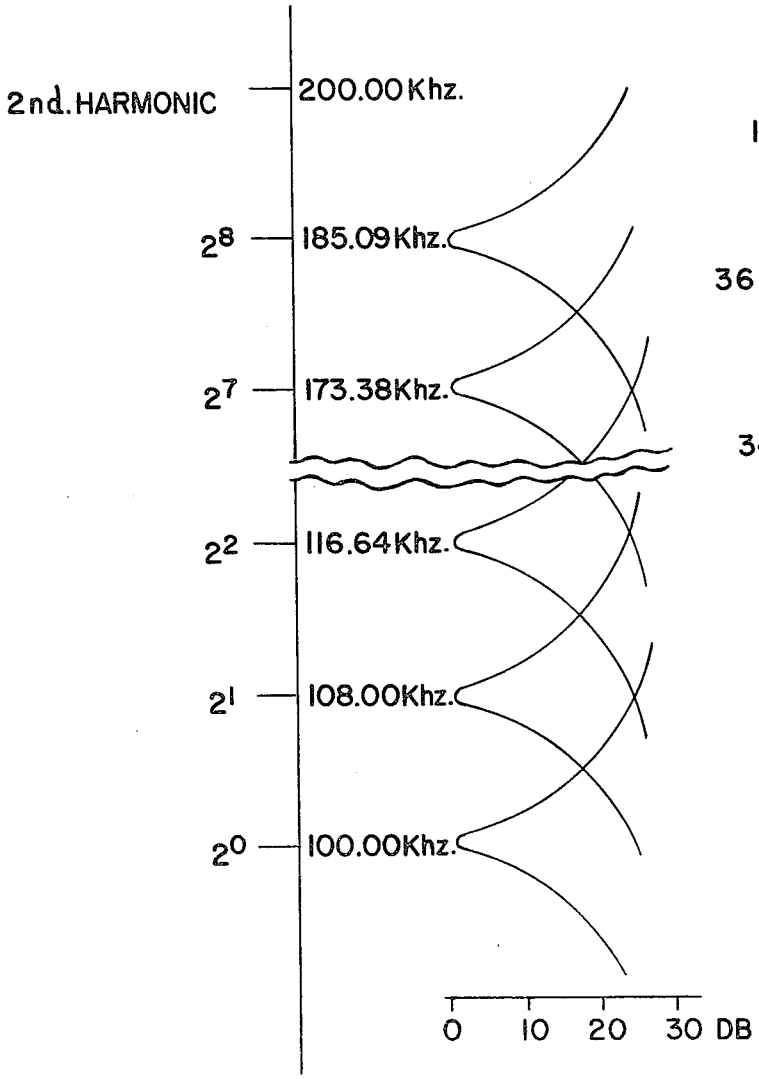
Fig 5
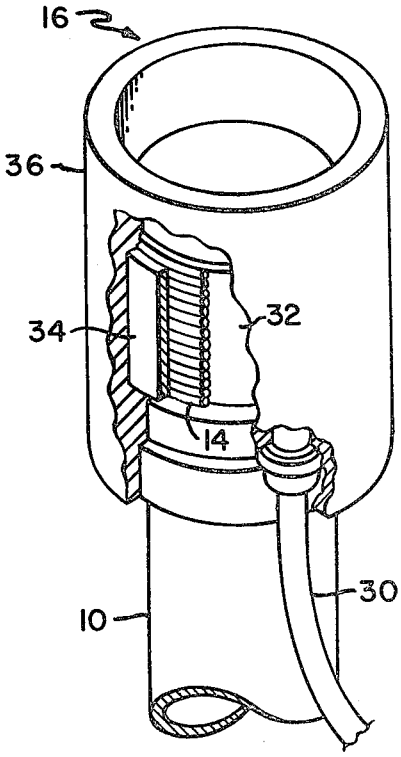
Fig 6
INVENTOR.
WILLIAM J. TUTEN
BY Charles M. Hogan
Irvin P. Garfield
ATTORNEYS.

DIGITAL FUZE

BACKGROUND OF THE INVENTION

The prior art teaches many systems for setting the fuze of a bomb or artillery shell. For example, the patents to Deloraine U.S. Pat. No. 2,557,949, Watt U.S. Pat. No. 2,555,384, and Schuler et al. U.S. Pat. No. 1,739,921 set the fuze of an artillery shell as it leaves the muzzle of the gun by adjusting the magnitude of a magnetic field through which the shell is passing. The White, Jr. et al. U.S. Pat. No. 3,211,057 shows the setting of a fuze in a bomb by means of a transformer arrangement in which one-half of the transformer is located within the bomb and the other half is located on the aircraft. None of the prior art of which I am aware provides a digital fuze having a plurality of binary bit positions, each of which is simultaneously set as the shell exits from the muzzle of the gun.

In accordance with this invention a binary code representing the time-to-go delay interval is set into the fuze by simultaneously transmitting a plurality of discrete frequency signals, each representing a digit in a binary coded command. The communication link comprises the magnetic field of a coil through which the receiver of the fuze physically passes. The system uses binary information which is serially inserted into a binary counter but which is read out in parallel so that all of the bit positions in the fuze are simultaneously set as the fuze passes through the coil after the projectile is fired, but before it leaves the muzzle of the gun.

DESCRIPTION OF THE DRAWINGS

FIG. 4 is a block diagram of the fuze system;

FIG. 5 shows the frequency spectrum of a preferred embodiment; and

FIG. 6 is an enlarged cutaway view of the transmitter positioned on a gun muzzle.

DESCRIPTION OF THE ILLUSTRATED EMBODIMENT

Figure 1:
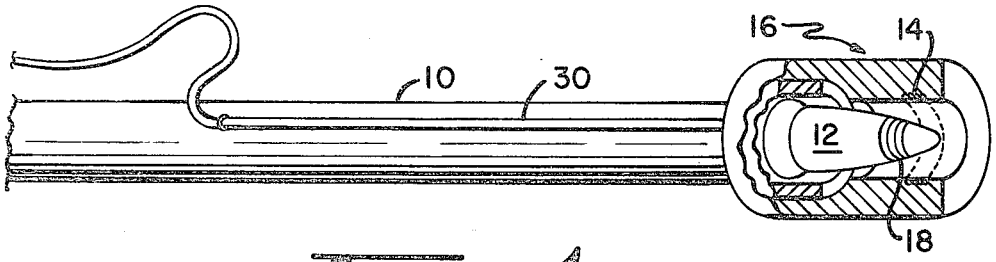
FIG. 1 is a diagrammatic representation of a gun equipped with a fuze setting system in accordance with this invention.

In FIG. 1 there is shown a conventional gun muzzle 10 through which a shell or round of ammunition 12 is passing. The round 12 contains a fuze settable to detonate after a predetermined delay period. The delay period, i.e., the time-to-go of the fuze, is in the form of binary coded information set into the fuze through a communications link. The communication link includes a transmitter having a transmitter (or drive) coil 14 potted in a gun barrel extension 16. The receiver portion of the communication link is provided in each shell round 12, and it includes a receiver coil 18 mounted on the round 12 so that its axis is concentric with the axis of the coil 14 when it passes through it. In FIG. 1, the coils 14 and 18 are shown in the approximate position where maximum energy is transferred.

When a round 12 is fired, the system operates to energize the drive coil 14 with a plurality of discrete frequency signals. In the illustrated embodiment nine such discrete frequencies are used, each frequency representing a bit position in a binary code. The presence of a signal on a given frequency represents a "1" while its absence represents a "0" for a particular bit position. As the round passes through the transmitter drive coil 14, the receiver in each round 12 picks up all of the simultaneously transmitted signals present in the generated field and each frequency present is independently detected. Any detected frequency results in a "1", each of such "1's " being simultaneously applied to a particular bit position of a binary counter in the fuze. The binary number is thus set into the counter to establish the time-to-go for the fuze.

Figure 2:
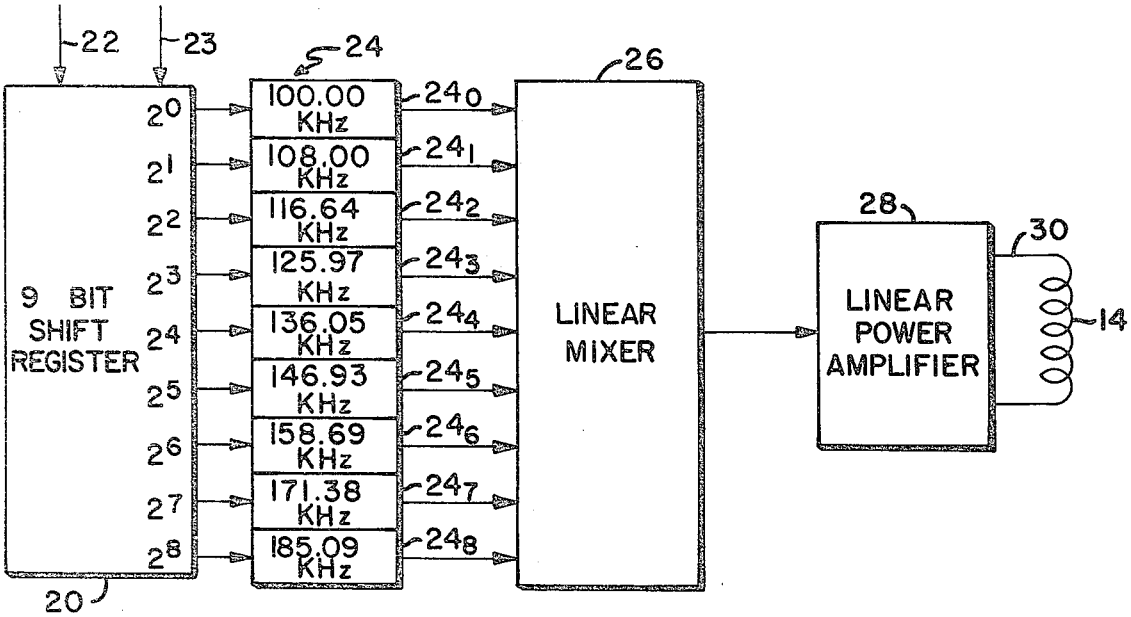
FIG. 2 is a block diagram of an electronic transmitter for transmitting binary coded information to the receiver of a fuze.

A block diagram of the transmitter used for simultaneously generating a plurality of discrete frequencies is shown in FIG. 2. The transmitter includes a conventional bit shift register 20 into which binary coded input data may be serially applied in a conventional manner at input terminal 22. In the particular embodiment a 9-bit shift register is employed. The "time-to-go" data for insertion into the shift register 20 would normally be derived in binary form from a range finder and computer (not shown).

With n binary digits, a total of $2^n$ discrete time intervals can be developed from the output of the register 20. Thus with a 9-bit counter, any one of 512 discrete time intervals can be set into the fuze. After a particular interval has been inserted into the shift register 20, the gun may then be fired and each bit in the shift register is simultaneously read out by applying a "fire" pulse to the data reset terminal 23. The read out from each bit position in the counter 20 is either a "1" or a "0", and each "1" or "0" is used to control a particular oscillator $24_0$–$24_8$. For example, the output at bit position $2_0$ is used to control a 100 KHz oscillator $24_0$ while the output at bit position $2_1$ controls a 108.00 KHz oscillator $24_1$, etc. In other words, the presence of a "1" at any bit position turns on a respective oscillator $24_0$ to $24_8$. The absence of a "1" at any particular bit position leaves the respective oscillator "off". Thus, binary digital data which is serially applied to the shift register 20 is thereafter read out in parallel simultaneously to provide the generation of up to nine discrete frequencies.

The generated discrete frequencies are then combined in a linear mixer 26 and amplified in a linear power amplifier 28. The output from the linear power amplifier 28 is then applied to the drive coil 14 through a cable 30. The output from the linear power amplifier is a complex waveform containing each of the discrete signals, each signal having a sufficient signal level to provide reliable receiver reception and being spaced so that there is very low harmonic and intermodulation distortion.

As illustrated in FIG. 5, all of the generated frequencies are selected to be within the same octave. That is to say, the nine discrete frequencies are spaced fractionally as far apart as possible, with the second harmonic of the lowest frequency being located above the highest frequency used. In the embodiment illustrated in FIG. 5, each frequency is 1.08 times higher than the next lower frequency, and the second harmonic is located the same factor (1.08) above the highest frequency used. This arrangement insures that the adjacent channel rejection factor (within the receiver) is constant for each channel is all filter channels in the receiver have the same "Q".

The details of the transmitter drive coil 14 located in the barrel extension 16 is shown in FIG. 6. The windings of the coil 14 are potted in a high impact resistant dielectric material 32 and are backed up by a high permeability split ferrite sleeve 34 to provide a low loss magnetic return path for the flux. The coil 14 along with the dielectric material 32 and the ferrite sleeve 34 are enclosed by a steel jacket 36 attachable to the end of the muzzle 10. The use of a ferrite sleeve 34 provides a low resistance flux path so that the eddy current losses potentially produced in the jacket are minimized. The ferrite sleeve 34 is maintained in place by means of an epoxy and breakage of the ferrite is avoided since its position within the steel jacket assures that the material is subjected only to compression, and never to tension.

Figure 3:
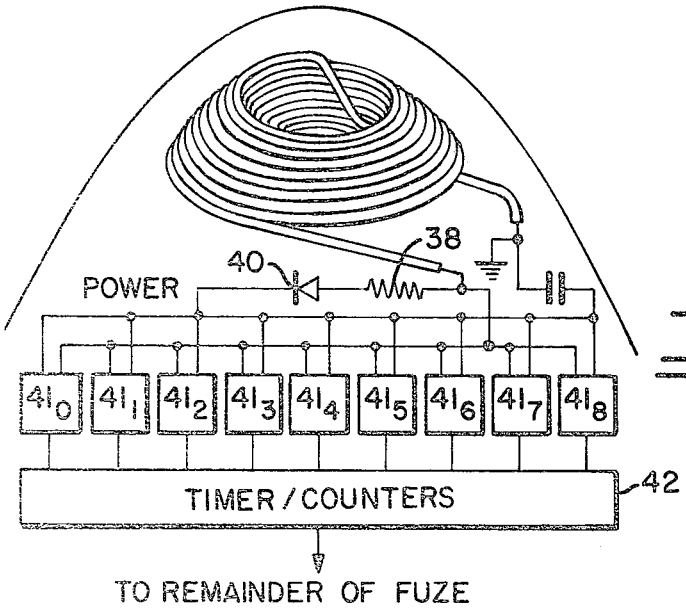
FIG. 3 is a schematic representation of the fuze, including its receiver.

A receiver, as shown in FIGS. 3 and 4, is used in each round. The receiver coil 18 is imbedded in the conventional plastic ogive of the round so that when the round passes through the transmitter drive coil the voltage induced by the transmitted magnetic field is coupled into the receiver by transformer action. The voltage wave generated by the transmitter contains those frequencies generated by the presence of a "1" in any particular bit position of the bit shift register 24. Thus, the voltage waveform contains those frequencies which carry the binary information for the fuze.

As shown in FIG. 3, the output from the receiver coil 18 is applied in two paths, one through a resistor 38 and a diode 40 to provide the power necessary to operate certain portions of the system and, second, to provide a signal to be delivered to nine filters $41_0$–$41_8$. Each of the filters $41_0$–$41_8$ is tuned to a frequency representing one of the binary bits. The individual filters $41_0$–$41_8$ separate the frequencies present in the complex waveform, and the output, if any, of each filter results in a "1" or "0" signal which is used to set a resultant binary number into a timer or counter 42. The "Q" of each filter is such that the discrimination against adjacent channel frequencies is at least 24 db. Each filter, by way of example, has a "Q" equal to 100 and may employ two N-channel MOS transistors of the depletion type.

A block diagram of the timing system for the fuze is shown in FIG. 4. The discrete frequencies picked up by the coil 18 are separated by the filters $41_0$–$48_8$ and are applied in parallel (or simultaneously) to the 9-bit binary counter 42, thus setting the binary counter 42 into any one of 512 intervals. The counter 42 is then counted down by means of a series of pulses supplied from the output of a conventional oscillator and divider 44. When the counter 42 is filled to the number set in, or emptied as the case may be, it develops an output voltage which is applied to a conventional detector and firing circuit 46. The output of the detector and firing circuit 46 serves to activate a detonator 48. Power for the system is provided by a power source 50. It will be understood, of course, that a portion of the power may be supplied as shown in FIG. 3 by means of the circuitry provided by the resistor 38 and diode 40.

SUMMARY OF THE INVENTION

In summary, this invention utilizes a complex electromagnetic signal containing a plurality of discrete frequencies, each representing a digit in a binary code. The electromagnetic wave is transmitted over a communications link comprising a transmitting coil for generating a magnetic field and a receiver coil, each receiving coil being associated with a detector and a time-to-go counter for a fuze. The detection of a frequency represents a "1" for a particular bit position in a binary counter, while the absence of a detected frequency represents a "0". All of the "0's" or "1's" are simultaneously set into the receiver counter to establish a time-to-go for the fuze. The communications link exists only during the time that the receiver coil is passing through the field of the transmitting coil.

While the invention has been disclosed in connection witn an artillery piece, it is clear that it is equally applicable for use in connection with mortars, bombs, mines, and even smaller munitions fired from hand-held guns. In addition, the concept can be used for command purposes other than fuzes, and it has utility wherever it is necessary, in a short period of time, to "parallel set" a digital code into a counter.

I claim:

1. In an ordnance fuze including a binary counter having a plurality of bit positions, means for setting a binary number into the bit positions of said counter, said number being the delay time of said fuze, means for counting down said counter until said number is reached, and means responsive to the reaching of said number for generating a detonation signal, said means for setting said binary number into said counter comprising in combination:

generator means for generating selected ones of a plurality of discrete frequencies, each of said frequencies representing a given bit position in a binary number, the presence or absence of such frequencies representing a "1" or a "0" in respective bit positions of a particular binary number;

a transmitter for transmitting said discrete frequencies;

a receiver remote from said transmitter and associated with said fuze for receiving said transmitted discrete frequencies;

means in said receiver for separating said discrete frequencies;

means responsive to each of said separated received frequencies for generating an output signal, the presence or absence of an output signal representing a "1" or a "0" in a respective bit position of said particular binary number; and means for applying each of said output signals to a respective bit position in said binary counter of said fuze for simultaneously setting all of the bits of said binary number into the bit positions of said counter.

2. The invention as defined in claim 1 wherein said generator means comprises a plurality of oscillators, each oscillator having a fixed frequency output, and a binary counter having a plurality of bit positions, each of said bit positions being operatively coupled to a given oscillator, each of said oscillators being turned on in response to the presence of a particular digit in a given bit position of a binary number.

3. The invention as defined in claim 1 wherein said transmitter includes a transmitting coil and wherein said receiver includes a receiving coil.

4. The invention as defined in claim 3 wherein said transmitting coil is fixed at the end of a gun muzzle and wherein said receiving coil is mounted on a shell to be detonated in response to said detonation signal, and wherein said receiver coil is electromagnetically coupled to said transmitting coil when said shell passes through said muzzle and said transmitting coil.

5. The invention as defined in claim 4 wherein the mounting for said transmitting coil comprises a dielectric tube, said tube being mounted at the end of said gun muzzle, a ferrite sleeve surrounding said coil, and a steel tube enclosing said ferrite sleeve.

6. The invention as defined in claim 1 wherein the highest of said discrete frequencies is higher than the lowest of said discrete frequencies.

7. The invention as defined in claim 6 wherein each of said discrete frequencies is a fixed ratio higher than the next lowest generated discrete frequency.

8. The invention as defined in claim 7 wherein said fixed ratio is 1.08.

9. A communications link for simultaneously setting a plurality of bit positions in a binary counter, the combination comprising:

generator means for generating selected ones of a plurality of discrete frequencies, each of said frequencies representing a given bit position in a binary number system, the presence or absence of such frequencies representing a "1" or a "0" in respective bit positions of a particular binary number, said generator means comprising a plurality of oscillators, each oscillator having a discrete fixed frequency output, and a first binary counter having a plurality of bit positions, each of said bit positions being operatively coupled to a given oscillator, each of said oscillators being turned on by the presence of a particular digit in a given bit position of a binary number;

means for simultaneously transmitting said selected ones of said discrete frequencies;

a receiver for simultaneously receiving all of said transmitted discrete frequencies;

means in said receiver for separating said received frequencies;

means for generating an output signal for each of such received frequencies, the presence or absence of an output signal representing a "1" or a "0" in said particular binary number; and a second binary counter having a plurality of bit positions, each of said output signals being applied to a respective bit position, whereby all of the bit positions of said second binary counter are simultaneously set.

10. The invention as defined in claim 9, and means for counting down said second binary counter at a predetermined rate until the number set in said second counter is reached.

11. A communications link for simultaneously setting a plurality of bit positions in a binary counter, the combination comprising:

generator means for generating selected ones of a plurality of discrete frequencies, each of said frequencies representing a given bit position in a binary number system, the presence or absence of such frequencies representing a "1" or a "0" in respective bit positions of a particular binary number;

means including a transmitting coil for simultaneously transmitting said selected ones of said discrete frequencies;

a receiver including a receiving coil for simultaneously receiving all of said transmitted discrete frequencies;

means in said receiver for separating said received frequencies; and means for generating an output signal for each of such received frequencies, the presence or absence of an output signal representing a "1" or a "0" in said particular binary number.

12. The invention as defined in claim 11 wherein said transmitting coil is fixed at the end of a gun muzzle and wherein said receiving coil is mounted in a shell, and wherein said receiver coil is electromagnetically coupled to said transmitting coil when said shell passes through said muzzle and said transmitting coil.

13. The invention as defined in claim 2 wherein the mounting for said transmitter coil comprises a dielectric tube, said tube being mounted at the end of said gun muzzle, a ferrite sleeve surround said coil, and a steel tube enclosing said ferrite sleeve.

* * * * *